US009156583B2

(12) United States Patent
Howard et al.

(10) Patent No.: US 9,156,583 B2
(45) Date of Patent: Oct. 13, 2015

(54) CONTAINER, CHIME AND ASSEMBLY OF BOTH

(75) Inventors: Gary Howard, Swavesey (GB); Iain McDerment, Melbourne (GB)

(73) Assignee: Anheuser-Busch InBev S.A., Brussels (BE)

( * ) Notice: Subject to any disclaimer, the term of this patent is extended or adjusted under 35 U.S.C. 154(b) by 512 days.

(21) Appl. No.: 12/449,489

(22) PCT Filed: Feb. 12, 2008

(86) PCT No.: PCT/EP2008/051689

§ 371 (c)(1),
(2), (4) Date: Nov. 19, 2009

(87) PCT Pub. No.: WO2008/098939

PCT Pub. Date: Aug. 21, 2008

(65) Prior Publication Data

US 2010/0072212 A1 Mar. 25, 2010

(30) Foreign Application Priority Data

Feb. 12, 2007 (GB) ..... 0702670.1
Dec. 14, 2007 (GB) ..... 0724456.9

(51) Int. Cl.
*B65D 21/02* (2006.01)
*B65D 8/00* (2006.01)
*B65D 25/24* (2006.01)

(52) U.S. Cl.
CPC ..... *B65D 7/045* (2013.01); *B65D 21/022* (2013.01); *B65D 25/24* (2013.01)

(58) Field of Classification Search
USPC ..... 220/605, 630, 634, 636, 649, 729, 220/DIG. 1, 646, 647, 648; 215/372, 376, 215/42; 206/152
See application file for complete search history.

(56) References Cited

U.S. PATENT DOCUMENTS

| | | | | | |
|---|---|---|---|---|---|
| 1,197,924 | A | * | 9/1916 | Ellinger | 220/320 |
| 2,489,766 | A | * | 11/1949 | Ernestus et al. | 220/634 |
| 3,095,111 | A | | 6/1963 | Mulder | |
| 3,349,940 | A | * | 10/1967 | Cornelius | 220/592.19 |
| 3,390,807 | A | * | 7/1968 | Cornelius | 220/632 |
| 3,840,141 | A | * | 10/1974 | Allom et al. | 220/628 |
| 4,022,345 | A | * | 5/1977 | Butz | 220/649 |
| 4,088,239 | A | * | 5/1978 | Uhlig | 220/649 |
| 4,103,806 | A | * | 8/1978 | White | 222/3 |
| 4,149,648 | A | * | 4/1979 | Uhlig | 220/649 |
| 4,482,067 | A | * | 11/1984 | Saito et al. | 215/386 |

(Continued)

FOREIGN PATENT DOCUMENTS

| | | |
|---|---|---|
| DE | 3140022 | 4/1983 |
| DE | 3336681 | 12/1984 |
| EP | 0826604 | 3/1998 |

OTHER PUBLICATIONS www.brewtree.com, Brewer's Dictionary, online article dated Jul. 20, 2014.

*Primary Examiner* — Fenn Mathew
*Assistant Examiner* — Chetan Chandra
(74) *Attorney, Agent, or Firm* — Levy & Grandinetti

(57) ABSTRACT

Container assembly comprising a container and a top chime fixed to each other, the container having a top part and a peripheral side wall, characterized in that the fixation between the chime and the container is situated at the top part of the container and at a distance from said peripheral side wall.

11 Claims, 4 Drawing Sheets

(56) References Cited

U.S. PATENT DOCUMENTS

Figure 1:
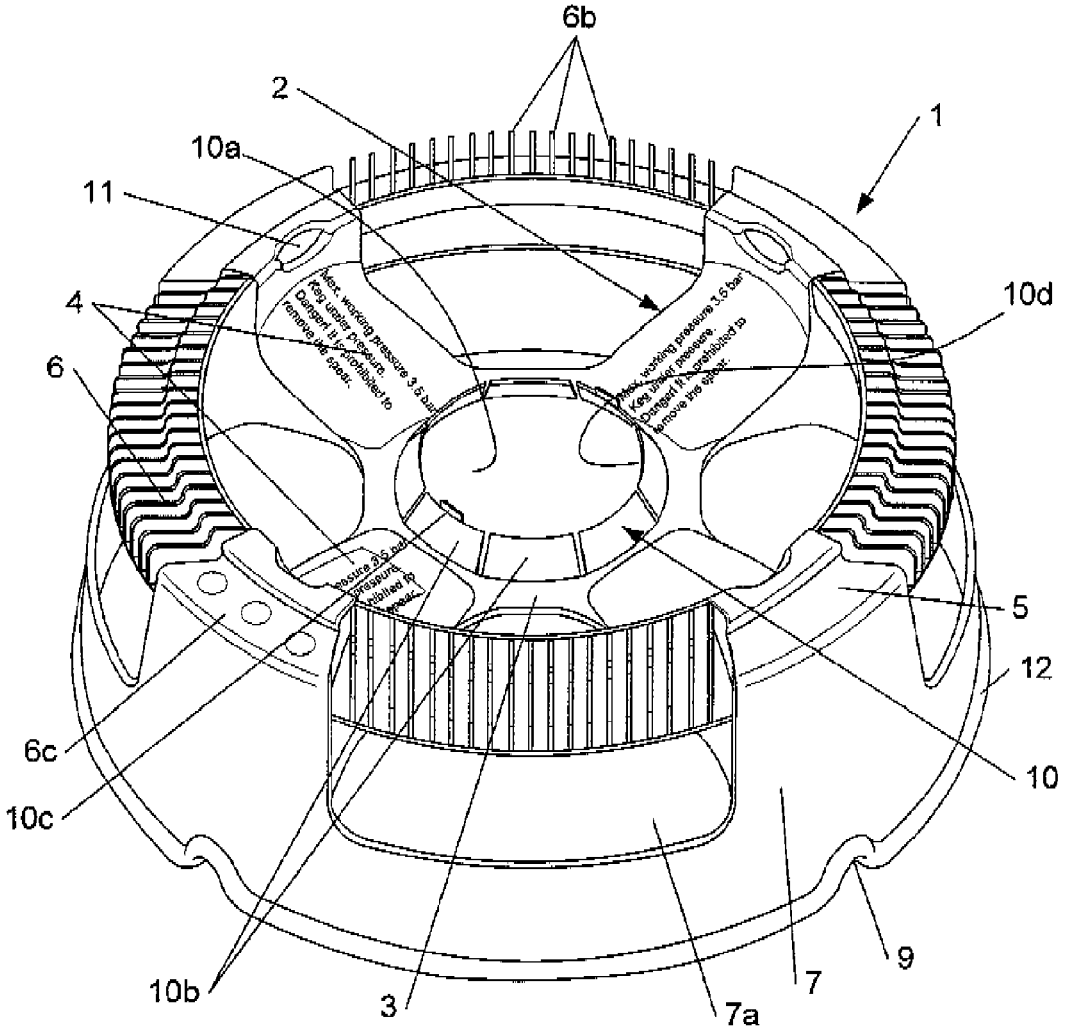

| | | | | | |
|---|---|---|---|---|---|
| D277,041 | S | * | 1/1985 | Nichols | D34/39 |
| 4,573,603 | A | * | 3/1986 | Starling et al. | 220/605 |
| 4,680,068 | A | * | 7/1987 | Hofstetter et al. | 156/196 |
| 4,867,348 | A | * | 9/1989 | Dorfman | 222/173 |
| 4,907,712 | A | * | 3/1990 | Stempin | 220/630 |
| 5,004,117 | A | * | 4/1991 | Kitsuda | 220/724 |
| 5,209,362 | A | * | 5/1993 | Lutzker | 215/225 |
| 5,709,252 | A | * | 1/1998 | Princiotta et al. | 141/18 |
| 6,223,397 | B1 | * | 5/2001 | Prevot et al. | 16/444 |
| 6,302,291 | B1 | * | 10/2001 | McCleerey | 220/630 |
| 6,386,384 | B1 | * | 5/2002 | Chohfi et al. | 220/23.91 |
| 6,409,049 | B1 | * | 6/2002 | de Pous et al. | 222/153.09 |
| 7,255,245 | B2 | * | 8/2007 | Oliveira et al. | 220/586 |
| 2009/0050638 | A1 | * | 2/2009 | Smith et al. | 220/636 |
| 2010/0072212 | A1 | * | 3/2010 | Howard et al. | 220/600 |
| 2010/0320214 | A1 | * | 12/2010 | Wauters et al. | 220/623 |

* cited by examiner

CONTAINER, CHIME AND ASSEMBLY OF BOTH

The Applicants claim priority to International Application Number PCT/EP2008/051689, filed on Feb. 12, 2008, Great Britain Application Number 0724456.9, filed on Dec. 14, 2007, and Great Britain Application Number 0702670.1, filed on Feb. 12, 2007.

FIELD OF THE INVENTION

The present invention relates to containers, particularly kegs and to chimes provided at the top part of said containers as well as to the chime itself.

BACKGROUND OF THE INVENTION

It is general practice to provide a container or keg with bottom and top chimes. These chimes usually perform several functions. A first function is purely protection of the base and top part of the kegs such that they are not damaged during handling. The base chime also provides a flat base for the keg, such that this can easily be placed in an upright position. In most cases, the top and bottom chime are designed to make kegs stackable and as such simplify transport and storage of the kegs. A further important function of chimes is to facilitate handling of the kegs. Indeed, most chimes are provided with a skirt that in a mounted position is situated at the periphery of the keg and that forms a rolling ring, such that when kegs are provided with bottom and top chimes, the kegs can be rolled easily when placed on their side, without the kegs sidewall touching ground.

In order to fix the chimes on a keg, several options are known. In most cases however the chimes are welded to the sidewall of the keg, which has the drawback that once applied, the chimes can not be removed, making the assembly of keg and chime difficult to recycle, especially since the chime and keg are usually manufactured in different materials.

This drawback has been overcome by DE3336681, wherein a chime is described that is snap-fitted behind protrusions provided at the periphery of a corresponding keg. In this case the chimes can be readily removed and replaced from the keg which simplifies both repair and recycling of both chimes and kegs. A drawback of this chimes however is that the snap fit is located quite distant from the center of the chime, such that the when tilting the keg by the chime on one side, the snap fit is subject of large stress and may loose and hence creates a safety problem.

With the growing demand for plastic kegs and the growing need for recycling and cost reducing processing, the application of the chimes on the kegs and the removal of said chimes off the kegs needs to be further simplified whilst assuring maximal safety.

SUMMARY OF THE INVENTION

The present invention nuts the above objectives by providing a container assembly comprising a container and a top chime fixed to each other, the container having a top part and a peripheral side wall, characterized in that the fixation between the chime and the container is situated at the top part of the container and at a distance from said peripheral side wall.

By redesigning the fixation of the chimes to the container, the applicant moved the attachment means to a central part of the base of the container. By doing so, the fixation of the chimes is no longer dependent on the peripheral circumference of the container. This offers the advantage that the fixation of the chime to the container can be made equal for containers of different dimensions, which clearly simplifies automation and processability, especially with regard to recycling.

Further advantages associated with various embodiments of the present invention include the snap on assembly of the chime, as it engages the keg neck finish, (which of course, lends itself to automated production). Moreover, in cases where no other means of fixation is employed, the top chime can be readily removed and recycled separately from the keg, and if appropriate easily replaced by another replacement chime so that the keg can be returned to production. In addition, the top chime provides for ease of handling, and its resilient flexibility provides for drop resistance benefits.

Preferably, the fixation between chime and container is releasable, such that the chimes can easily be replaced when damaged. In the most preferred embodiment, the fixation is achieved by a snap fit between the chime and the container.

The present invention also relates to the container itself, as in order to enable the above fixation, the container according to the invention has a base that is provided with attachment means situated at a distance from the containers peripheral sidewall.

A chime according to the invention comprises at least a inner hub provided with fixation means and an outer skirt that is designed to engage part of the peripheral sidewall of a container.

INTRODUCTION TO THE DRAWINGS

FIG. 1 of the drawings appended hereto depicts a top-side elevated perspective view into a preferred embodiment of a plastic top chime according to the present invention.

Figure 2:
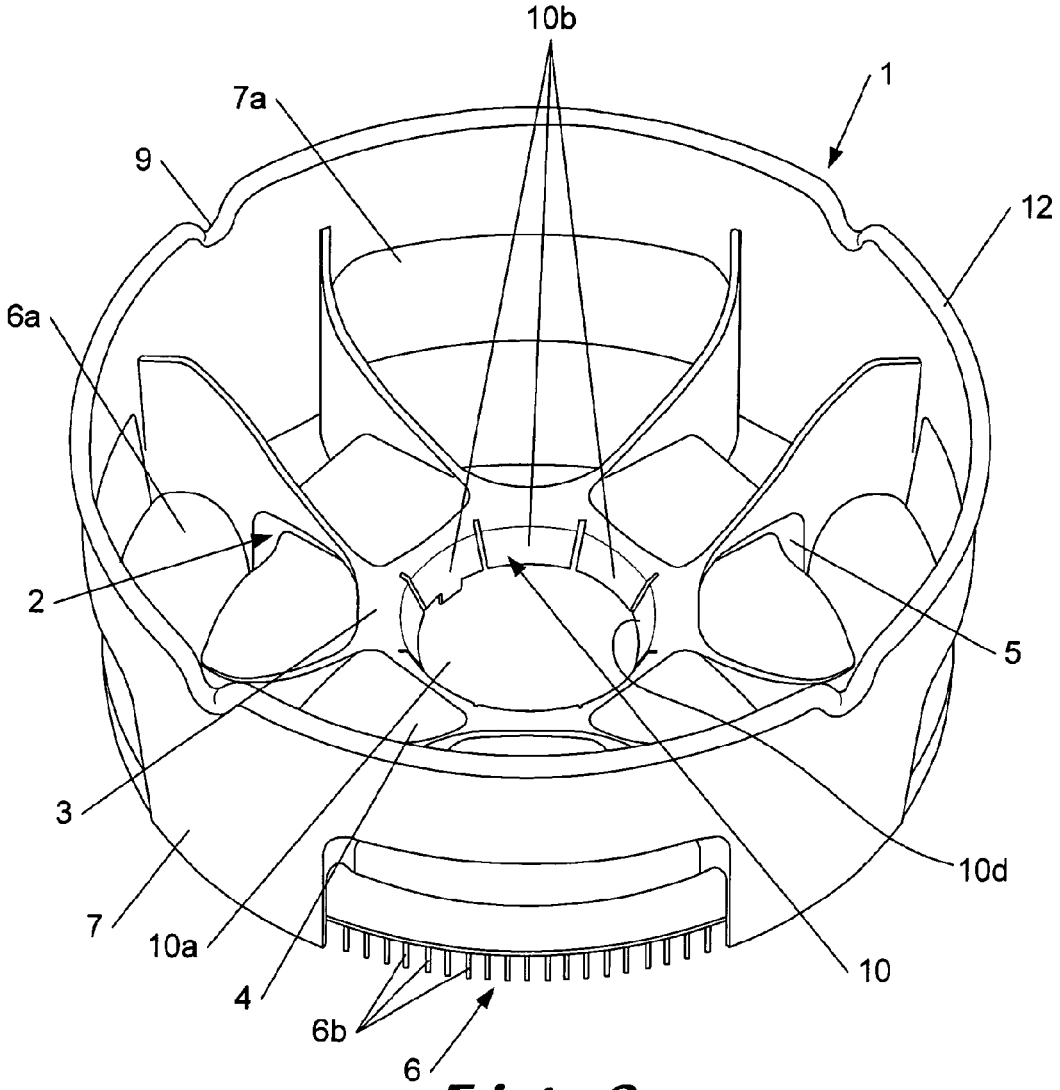

FIG. 2 of the drawings appended hereto illustrates an underside, elevated perspective view of a preferred embodiment of a plastic top chime according to the present invention.

Figure 3:
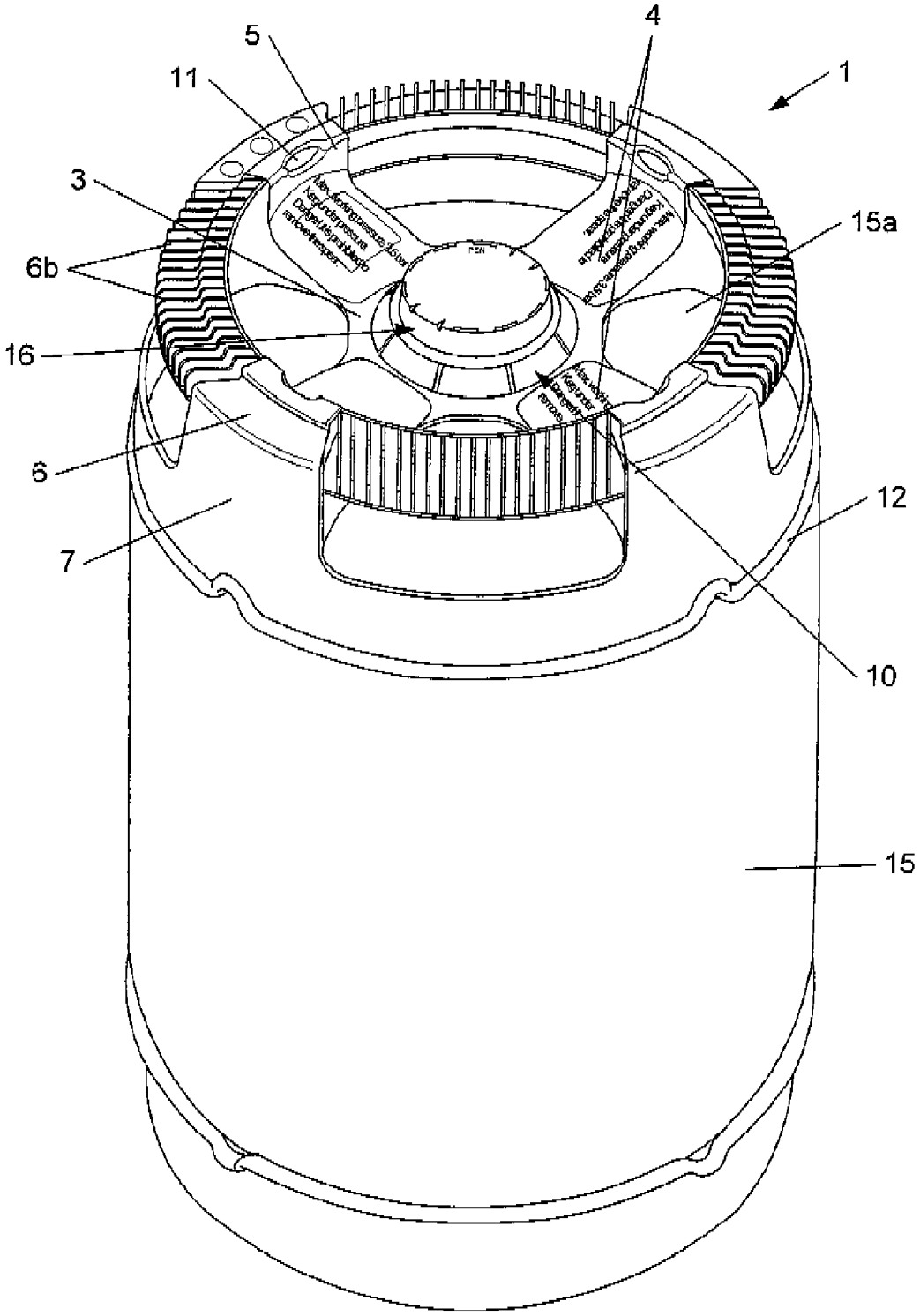

FIG. 3 of the drawings is a perspective view of the top chime of the present invention mounted on a complementary keg having a cooperating neck finish.

Figure 4:
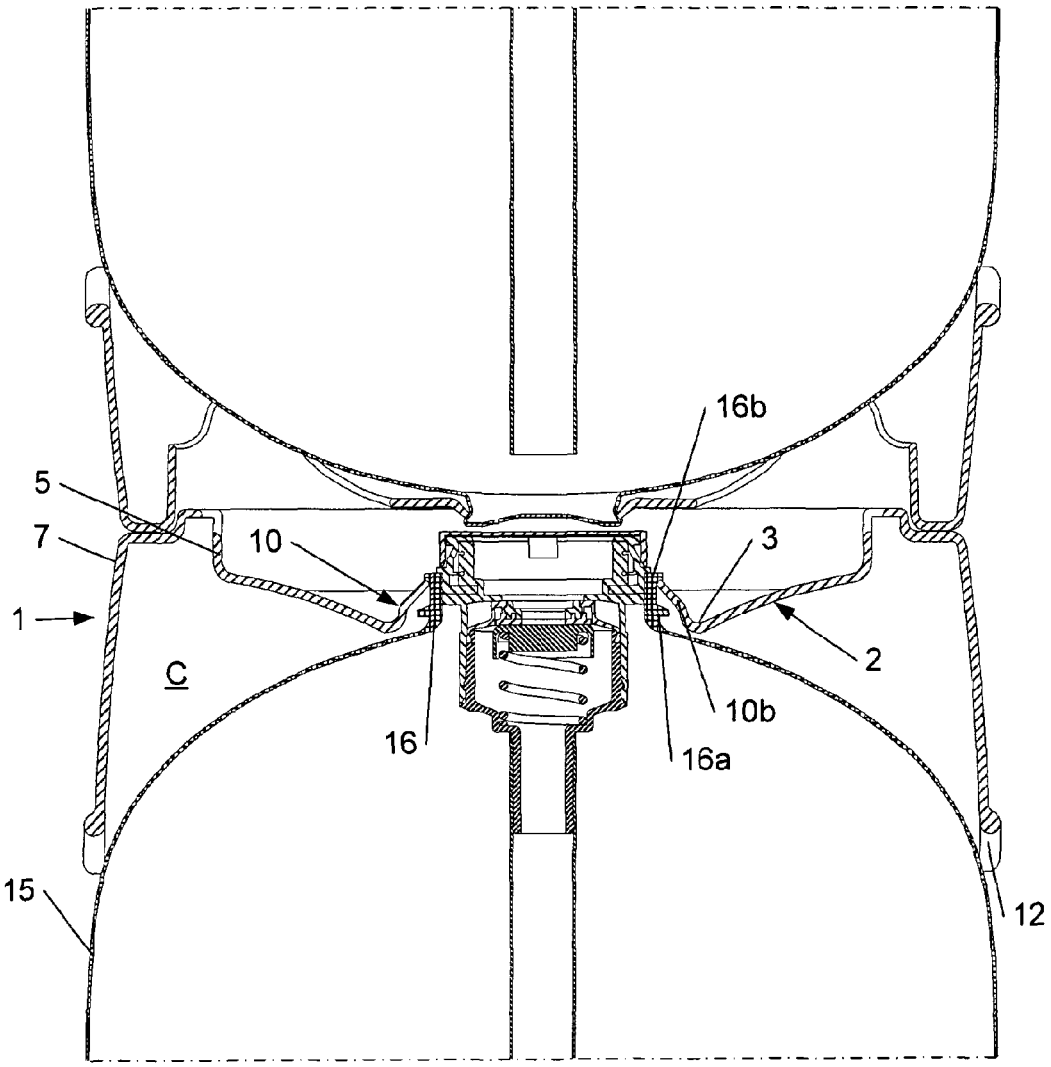

FIG. 4 of the drawings is a cross-sectional view taken through the top chime according to the present invention, in combination, (i.e. in mounted relation) on a beer keg of the present invention, shown in inter-fitting stacked relation with a complementary top chime of a superposed keg.

DETAILED DESCRIPTION OF A PREFERRED EMBODIMENT

Referring in general to FIGS. 1 and 2 of the appended drawings, there is provided a preferred keg (or container) top chime 1 according to the present invention. Keg top chime 1 comprises a keg neck finish surround 10. Surround 10 is specifically adapted to engage a cooperating keg neck finish (not shown in FIGS. 1 and 2, but refer instead to FIGS. 3 and 4). That engagement sustains a mutually inter-fitting secured relation to thereby at least partially secure the chime to the keg.

In this preferred form of the chime 1 according to the present invention, surround 10 comprises an opening 10*a*, which is circumscribed by respective free ends 10*d* of a plurality of resilient, flexible tines 10*b*. Tines 10*b* extend radially inwardly into opening 10*a*, from fixed ends of said tines 10*b* that are rooted on a inner, preferably central hub 3.

Note that at least one of said free ends 10*d*, and preferably a plurality thereof, include a tab extension 10*c*, adapted to engage in corresponding register with a complementary slot (not shown) in a keg neck finish. Although the function of this arrangement could be accomplished in other ways that still fall within the scope of the present invention (i.e. merely by engaging respective tines in respective individual slots in the neck finish), the tabs are well suited to interfering with any rotation that might otherwise be possible between chime 1 and the neck finish, relative to the keg body.

Chime 1 includes a "spider" 2 for engaging a top portion of a keg body (again, not shown in FIGS. 1 and 2, refer to FIGS. 3 and 4 and the description that follows below), in surmounted relation by chime 1. The spider 2 in turn comprises the central hub 3 with a plurality of radially outwardly extending legs or spoke girders 4. These spoke girders terminate at a rim wall 5, of a downwardly depending chime skirt 7.

Spoke girders 4, have channel cross-sections including said walls C that provide a stiffened girder effect and function as support fillets between the central hub 3 and the chime skirt 7.

A handle ring 6 is also arranged to interconnect the radially outmost extent of the spokes, and is spaced above and apart from chime skirt 7. Handle ring 6 has a curved underside 6*a* adapted to facilitate hand holds, and a plurality of raised fins 6*b* on an opposed surface that function to facilitate hand grips and as a continuation of the supporting surfaces 6*c* that form the roots for respective spoke girders 4 where they join with skirt 7. Additionally, any liquids that fall onto the handle ring is channeled downwardly between fins 6*b* and away from the handhold portion of the chime, to help ensure a non-slippery grip.

Chime skirt 7 supports a peripheral bead 12 adapted to engage adjacent surfaces of the secured keg body.

Chime skirt 7 also includes hand holes 7*a*, positioned below raised fins 6*b*, and forming an opening into a "pocket" between the top side of the keg body in between girder side walls C of adjacent pairs of spokes, to thereby permit the handle ring 6 to be griped from between chime 1 and proximal but spaced apart portions of the keg body top 15*a*.

Skirt 7 also includes keg body drains 9 for draining liquids accumulating between the skirt 7 and an associated keg body wall. When in use, keg assemblies according to the present invention can accumulate water or other liquids that would remain trapped between the chime and the keg when the assembly is oriented in its normal upright position, but which is permitted to drain away through these drains 9.

Similarly, handle ring 6 includes channel drains 11 for draining liquids accumulating within the interior of the girder cross sections of spokes 4.

Notably, keg assemblies according to the present invention are often washed and filled in an inverted orientation, during which time water might otherwise accumulate unless permitted to drain away through these drains. Note in this connection that the keg of the present invention and assemblies comprising same are preferably closed-system kegs.

Referring now FIG. 3 the chime 1 is illustrated in mounted relation on keg body 15.

Note in particular the engagement of tines 10*b* with the portion of keg neck finish 16 that extends through surround 10—and in particular, the engagement of the free ends of tines 10*b* below neck finish abutment 16*b*. Also note that peripheral bead 12 engages keg body 15 proximal to the transition between the top shoulders and cylindrical or peripheral side wall of the keg. The keg and chime assembly as illustrated in FIG. 3 comprises keg body 15 having a top 15*a* bearing a keg neck finish 16. Keg top chime 1 comprises a keg neck finish surround 10. The keg top finish surround 10 and the keg neck finish 16 are mutually adapted to engage a cooperating, inter-fitting secured relation to thereby at least partially secure said chime and keg in mutually assembled relation. In the variously illustrated embodiments, the inter-fitting secured relation is a resiliently biased mechanically interfering registration between the salient portions of keg 15 and said chime 1.

Referring now to FIG. 4 in particular, there is shown a cut away section through a stacked pair of kegs, illustrating in greater detail the engagement of the chime 1 with keg body 15, and a complementary stacking relationship of chime 1 with a top chime of the surmounted keg assembly above it. Although not visible in either FIG. 3 or 4, tabs 10*c* extend into tab receiving mouths located in the neck finish, to secure the chime 1 against rotation relative to the keg body 15.

Keg body 15 comprises a shoulder shaped top 15*a* extending upwardly from the rest of the kegs cylindrical body. Top 15*a* has a keg neck finish 16, which is adapted to engage a complementary keg neck finish surround 10 of keg top chime 1, (also illustrated in FIGS. 1 and 2).

Neck finish 16 includes generally upstanding side walls 16*a* extending proud of the adjacent periphery of the keg body 15 top 15*a* and terminating in an overhanging annular abutment 16*b* that is particularly suited to engage in snap-on inter-fitting secured relation with the complementary features of top chime 1 as described elsewhere herein.

Spoke girders 4 are curved along edges of side walls C to conform in shape along adjacent surfaces of keg top portion 15*a*, to be supported in contacting relation there along.

The resulting chime 1 is a particularly light weight design, and introduces relatively low material costs to the overall keg assembly.

It is clear that in order to fix a chime 1 according to the invention to a keg, it suffices to position the chime 1 with the opening 10 over the keg neck finish and to press it down such that the flexible tines snap into the slot in the keg neck finish.

In the case the keg is a plastic keg, it is preferred to provide an internal overpressure in the keg in order to avoid any deformation thereof during fixation of the chime 1.

For removal of the chime 1, one can tear of the chime 1, although the removal can easily be automated by use of a cylindrical drill, breaking the tines 10*b*, whereby the chime 1 will fall of the keg as are the tines 10*b*. Such automated and simple removal of the chime obviously simplifies recycling the keg assemblies.

Finally it is remarked that both the keg and the chime can have various forms. The kegs for example can have a circular cross section, a rectangular cross section or a cross section in any other shape.

The invention claimed is:

1. Container assembly comprising a container and a top chime fixed to each other, the container having a peripheral side wall body and a top part comprising a shoulder extending upwardly from the body to a neck finish, said neck finish comprising at least one slot, the top chime having an inner hub and an outer skirt spaced at a distance of the inner hub, and having fixation means situated at the inner hub thereof, said fixation means having a surround that comprises an opening circumscribed by respective free ends of a plurality of resilient tines extending radially inwardly from the inner hub, at least one of said free ends including a tab extension, wherein said free ends of the plurality of resilient tines engage a complementary surround at the neck finish of the container such that the fixation between the top chime and the container is situated at the neck finish of the container, wherein said fixation is a releasable fixation, and wherein, said tab extension tinges with the slot in the neck finish of the container to interfere with any rotation possible between the top chime and said neck finish, relative to the container body.

2. Container assembly according to claim 1, characterized in that the fixation is a snap-fit.

3. Container assembly according to claim 2, characterized in that the chime comprises, a plurality of legs extending radially outwardly from the inner hub, and terminating in a rim wall of a skirt, whereby the skirt engages the peripheral side wall of the container.

4. Container assembly according to claim 1, characterized in that the chime comprises a plurality of legs extending radially outwardly from the inner hub, and terminating in a rim of a skirt, whereby the skirt engages the peripheral side wall of the container.

5. A top chime suitable for being fixed to a neck finish of a container comprising at least one slot, said top chime having an inner hub and an outer skirt spaced at a distance of the inner hub, characterized in that the top chime is provided with fixation means situated at the inner hub thereof, wherein said fixation means has a surround that comprises an opening circumscribed by respective free ends of a plurality of resilient tines extending radially inwardly from the inner hub suitable for forming a releasable fixation with a complementary surround at the neck finish of the container provided with at least one slot, and in that at least one of said free ends includes a tab extension suitable for engaging with said at least one slot.

6. A top chime according to claim 5, characterized in that said top chime comprises a handle ring provided with a plurality of raised fins.

7. A top chime according to claim 5, characterized in that said top chime comprises, a plurality of legs extending radially outwardly from the inner hub, and terminating in a rim wall, said rim wall spacing apart both a skirt and a handle ring.

8. A top chime according to claim 5, characterized in that said top chime comprises a handle ring provided with a plurality of raised fins.

9. A top chime according to claim 5, characterized in that:

at least one of said resilient tines is provided with a tab extension; and said top chime comprises a plurality of legs extending radially outwardly from the inner hub, and terminating in a rim wall, said rim wall spacing apart both a skirt and a handle ring.

10. A top chime according to claim 5, characterized in that:

said top chime comprises a handle ring provided with a plurality of raised fins; and said top chime comprises a plurality of legs extending radially outwardly from the inner hub, and terminating in a rim wall, said rim wall spacing apart both a skirt and a handle ring.

11. A top chime according to claim 5, characterized in that:

at least one of said resilient tines is provided with a tab extension;

said top chime comprises a handle ring provided with a plurality of raised fins; and said top chime comprises, a plurality of legs extending radially outwardly from the inner hub, and terminating in a rim wall, said rim wall spacing apart both a skirt and a handle ring.

* * * * *